US006716314B2

(12) United States Patent
Johnson et al.

(10) Patent No.: US 6,716,314 B2
(45) **Date of Patent: *Apr. 6, 2004**

(54) METHOD FOR MAKING IMPROVED ABRASION RESISTANT OVERLAYS

(75) Inventors: Mark A. Johnson, Chillicothe, OH (US); John Benson, Lee, MA (US); Mahendra Mehta, Pittsfield, MA (US); Steve Canary, Westfield, MA (US); Eric Girardin, Westfield, MA (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/794,427

(22) Filed: Feb. 27, 2001

(65) Prior Publication Data

US 2002/0117281 A1 Aug. 29, 2002

(51) Int. Cl.[7] ..... D21H 27/28; D21H 17/69

(52) U.S. Cl. ..... 162/181.1; 162/158; 162/181.4; 162/165; 162/177; 162/181.6; 162/168.1; 162/169; 427/213.3; 427/420

(58) Field of Search ..... 162/181.1–181.2, 162/181.4, 181.5, 181.6, 177, 158, 168.1, 169, 164.4, 164.1, 179, 183–185; 428/323, 329, 331, 531.5, 402, 402.24, 330; 427/420, 213.3

(56) References Cited

U.S. PATENT DOCUMENTS

| | | | | |
|---|---|---|---|---|
| 3,786,041 A | | 1/1974 | Talsma | |
| 4,940,503 A | * | 7/1990 | Lindgren et al. | 156/279 |
| 5,314,513 A | * | 5/1994 | Miller et al. | 51/295 |
| 5,344,704 A | | 9/1994 | O'Dell et al. | 428/323 |
| 5,820,937 A | | 10/1998 | Crabtree et al. | 427/420 |
| 5,962,123 A | | 10/1999 | Mehta et al. | 428/326 |
| 5,962,134 A | | 10/1999 | Shah et al. | 428/407 |
| 6,013,696 A | | 1/2000 | Hill et al. | 523/149 |
| 6,287,681 B1 | * | 9/2001 | Mehta et al. | 428/323 |
| 6,290,815 B1 | * | 9/2001 | Magnin et al. | 162/181.1 |
| 6,551,455 B2 | * | 4/2003 | Johnson et al. | 162/128 |

FOREIGN PATENT DOCUMENTS

| | | |
|---|---|---|
| WO | 9726410 | 7/1997 |

* cited by examiner

*Primary Examiner*—Jose A. Fortuna
(74) *Attorney, Agent, or Firm*—Thompson Hine LLP

(57) ABSTRACT

A method for forming an abrasion resistant sheet which comprises forming a web of cellulosic fibers on a papermaking machine and applying a slurry including an encapsulated abrasion-resistant grit to the upper surface of the web on the papermaking machine.

27 Claims, 2 Drawing Sheets

METHOD FOR MAKING IMPROVED ABRASION RESISTANT OVERLAYS

FIELD OF THE INVENTION

The present invention relates to a method for making improved abrasion resistant overlays for use in making decorative laminates and the like. More specifically, the present invention provides improved an improved method for making abrasion resistant overlays for use in making decorative laminates and the like using grit particles, generally aluminum oxide, that have been micro-encapsulated in a resin, generally melamine-formaldehyde resin.

BACKGROUND OF THE INVENTION

Decorative laminates are conventionally manufactured by assembling several layers of a sheet material such as paper or fabric impregnated with resins of various kinds. Typically, the resins may be selected from phenolics, aminoplasts, polyesters, polyurethanes, epoxy resins, melamine resins and the like.

The selection of the paper or fabric to be used, and the resin for impregnation is governed by the intended end-use of the finished laminate. For some end uses, surface decoration is not required, but in many instances colors and/or patterns are desired to add eye appeal to the finished laminate. While color and/or pattern decoration may be desired for an outer surface of the laminate, the core or base functions primarily as a strengthening support, and may comprise wood, such as plywood, multiple layers of unbleached or dark colored paper or cloth, and may utilize dark colored, less expensive impregnating resins, such as phenolic resins.

However, when a decorated or printed surface is desired in the laminate, an outer surface layer known as a decor sheet is used to cover the core layer or layers. The decor sheet can be colored decorative paper which may be pigmented with titanium dioxide and/or other opacifying pigments or printed decorative paper, where decorative paper is further printed with patterns to mask the dark-colored core stock. The decor layer may be impregnated with a wide variety of resins such as melamine resins, polyester resin, etc.

Needless to say, given that the decorative laminates discussed herein are often exposed to foot traffic (when used in flooring) or general wear and tear (when used in countertops and the like) it is generally desired to protect the decor layer in some manner that would prevent damage to the decorative image. To impart the desired wear and/or abrasion resistance to these decorated laminates, it has long been the practice to place a resin-impregnated surfacing paper known as an overlay sheet over the decor sheet. Upon consolidating the laminate, the overlay sheet becomes transparent, permitting the printed pattern on the decor sheet to be seen through the overlay sheet. Recently, it has been found that small inorganic particles, known in the industry as "grit," can be added to the overlay sheet to impart added abrasion resistance to the laminates incorporating them. This grit, which very frequently is comprised of aluminum oxide particles, can also be added directly to the printed decor papers that have been coated with resins. While there have been many methods disclosed for the addition of the grit to these papers, as will be discussed in detail below, there are several methods that are preferred.

However, regardless of the method that is used to incorporate the grit into the paper, be it overlay or decor sheet, the use of the grit in the papermaking process has added heretofore non-existent problems. More specifically, while the addition of grit to these papers has been used effectively to produce laminates having desirable wear-resistant properties, the use of the highly-abrasive grit can cause problems in the papermaking process. For example, the mixing and transportation of the abrasive slurries carrying the grit to the point where the grit is added to the paper itself results in a large amount of wear on the pumps, pipes, and other process equipment used in the process. Additionally, once the grit has been added to the paper, the presence of the grit on the paper significantly adds to the wear and tear on the drying machines and other downstream equipment. Most importantly, though, the presence of the grit in the paper during the lamination process can result in damage and wear to the highly polished caul plates. Thus, for all of these reasons, it is considered highly desirable to lessen or eliminate the wear and tear on the equipment used to make wear resistant overlay paper as well as the caul plates used to laminate that paper while maintaining the wear-resistant properties of the paper itself.

In attempting to address these problems, it has been found that by using grit, such as aluminum oxide particles, which have been micro-encapsulated in a melamine-formaldehyde or a similar type of resin prior to adding the grit to the papermaking process, that wear and tear on the paper and laminating process machinery is reduced while the wear-resistant properties of the end product laminate made using the paper are not significantly diminished. In this regard, U.S. Pat. No. 5,962,134 to Shah et al. discloses one technique for encapsulating grit particles in melamine-formaldehyde resin. However the Shah et al. reference is silent as to preferred methods for incorporating the micro-encapsulated grit into finished paper products. Additionally, AU 9806636 owned by Depco Pty Ltd entitled Wear Resistant Surfaces and Laminates discloses that similar micro-encapsulated abrasive particles can be added to overlay paper during the papermaking process. As with the Shah et al. patent, though, the Depco reference is relatively silent on the incorporation of the micro-encapsulated grit particles into the papermaking process saying only that the micro-encapsulated grit should be incorporated "with and or supplementary to the other raw materials." Similarly, WO 97/26410 owned by Arjo Wiggins S. A. discloses the utility of the use of micro-encapsulated grit in wear resistant overlay and decor papers for decorative laminates without providing much guidance as to the incorporation of the grit into the papers themselves.

Thus, while these references disclose the general utility of adding micro-encapsulated grit to overlay-type laminate papers, they fail to disclose the preferred methods for incorporating these materials into the papers efficiently and effectively. Accordingly, it would be desirable to have a method for incorporating micro-encapsulated grit particles in overlay or decor laminating papers that is inexpensive, efficient, causes minimal damage to papermaking equipment, and provides finished papers having the desired wear-resistant properties.

SUMMARY OF THE INVENTION

The present invention relates to preferred methods for applying micro-encapsulated grit to a fibrous cellulosic overlay or decor sheet, generally paper, in a manner which is inexpensive, efficient, causes minimal damage to papermaking equipment, and provides finished papers having the desired wear-resistant properties. More specifically, the present invention provides methods for producing such paper for use in wear-resistant laminates wherein particles of micro-encapsulated grit are evenly distributed across the surface of the paper and are preferably incorporated in the paper in the z-direction. Additionally, the present invention provides methods for producing such paper for use in wear-resistant laminates that are efficient in the distribution of micro-encapsulated grit on and in the paper fibers, that are efficient in their use of water in the papermaking process, that result in relatively little waste of the micro-encapsulated grit materials, and that can be used in laminates to create the desired wear-resistant and decorative properties. Finally, the present invention provides methods for producing such paper for use in wear-resistant laminates wherein the papermaking equipment and laminating equipment are protected, where possible, from unnecessary wear and tear.

Specifically, the present invention provides methods for producing paper for use in wear-resistant laminates wherein micro-encapsulated grit is deposited on and through the paper by means of the primary headbox or a secondary headbox at the "wet end" of the papermaking machine. In another preferred embodiment, the micro-encapsulated grit is applied using a slot orifice coater positioned at the wet end of paper machine. In this preferred embodiment, the use of a slot orifice coater (as contrasted with a secondary headbox) increases the efficiency and uniformity of the micro-encapsulated grit application and reduces waste. In an alternate preferred embodiment, the micro-encapsulated grit is applied at the "dry end" of the papermaking machinery thereby preventing unnecessary wear on the paper drying machinery and felts. In this preferred embodiment, the micro-encapsulated grit is preferably only partially cured thereby enhancing the ability of the particles to adhere to the paper.

In the preferred embodiment where the micro-encapsulated grit is applied through the primary headbox, the preferably fully cured micro-encapsulated grit is mixed directly into the paper slurry prior to the deposition of the slurry on the paper wire. This method is preferable to other methods in that the micro-encapsulated grit is incorporated in the paper throughout the z-direction thereby enhancing the long-term abrasion resistant qualities of the resultant paper. The drawbacks of this method include some damage to the recycling pumps and slurry tank as well as potential loss of micro-encapsulated grit to the floor, etc. due to the relatively inefficient nature of the headbox application method.

In the preferred embodiment where the micro-encapsulated grit is applied using a secondary headbox, the secondary headbox can be located anywhere downstream of the primary headbox prior to the dryers, i.e. anywhere on the "wet end." This method is preferable to other methods, such as dry-end addition, in that the micro-encapsulated grit is incorporated in the paper throughout the z-direction, and the extent to which the micro-encapsulated grit penetrates the paper fibers is adjustable depending on how far down the wire the secondary headbox is located. As mentioned above, the incorporation of the micro-encapsulated grit particles in the z-direction enhances the long-term abrasion resistant qualities of the paper made by the process. The drawbacks of this method, as in the use of the primary headbox, include some damage to the recycling pumps and slurry tanks as well as potential loss of micro-encapsulated grit to the floor, etc. due to the relatively inefficient nature of the headbox application method.

In the preferred embodiment where the micro-encapsulated grit is applied using a slot orifice coater, the slot orifice coating head applicator is may be positioned anywhere after the primary headbox and before the dryers, but it is preferably located near and, more preferably, immediately after the dry line, i.e., the point at which the deposited fibers begin to exhibit consolidation and there is no layer of surface water. Preferably, the slot orifice coater includes a bead-type or curtain-type applicator, and is most preferably a curtain-type applicator. Also it is preferred that the slot orifice coater is used in conjunction with a positive displacement pump which enables a predetermined amount of the micro-encapsulated grit composition to be evenly distributed across the surface of the cellulosic paper sheet. A static mixer may be incorporated in the slot orifice coater supply line to prevent or reduce the amount of micro-encapsulated grit settling out of the slurry.

In the preferred embodiment wherein the micro-encapsulated grit is deposited on the paper web at the dry end of the papermaking machine, i.e. after the dryers, the grit is applied to the web using a powder coater or similar-type process equipment to evenly distribute the micro-encapsulated grit on the web. In this preferred embodiment, the micro-encapsulated grit is preferably only partially cured thereby facilitating the adhesion of the grit to the paper web. Preferably, if the dryer cans have imparted too much heat to the web creating a "tacky" surface after the micro-encapsulated grit has been deposited, an extra set of chilled rollers is supplied to cure the "tacky" web prior to winding.

Other objects and advantages will be apparent from the following description, the drawings and the appended claims.

DETAILED DESCRIPTION OF THE INVENTION

Figure 1:
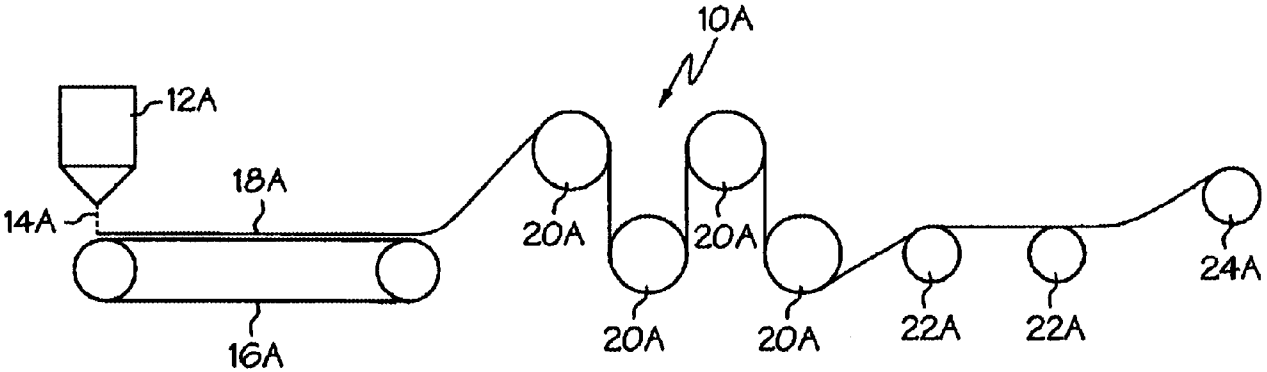
FIG. 1 is a schematic diagram of a papermaking process for use in accordance with an embodiment of the method of the present invention wherein the micro-encapsulated grit is deposited on the web through the primary headbox.

Initially, with respect to all of the embodiments of the invention disclosed herein, the grit employed in the present invention prior to micro-encapsulation can be a mineral particle such as silica, alumina, alundun, corundum, emery, spinel, as well as other materials such as tungsten carbide, zirconium boride, titanium nitride, tantalum carbide, beryllium carbide, silicon carbide, aluminum boride, boron carbide, diamond dust, and mixtures thereof. The suitability of the particular grit will depend on several factors such as availability, cost, particle size distribution and even the color of the particles. Considering cost availability, hardness, particle size availability and lack of color, aluminum oxide is generally the preferred grit for most applications. End use performance dictates the basis weight, ash loading, size and type of grit particles. The grit preferably has an average particle size of about 10 to 100 microns and a particle size distribution of about 10 to 150 microns.

Further, if micro-encapsulated grit is to be used in accordance with the present invention as disclosed above, the micro-encapsulation coating may be any suitable polymeric coating but is preferably an aminoplast or phenoplast resin. Furthermore, the micro-encapsulation of the particles may be accomplished by many of the micro-encapsulation methods known in the art including the following: injection treatment coating wherein particles in a shear zone are spray-coated; fluid bed coating, including Wurster & related coating processes, wherein the grit is spray coated in a fluid bed of particles; conventional spray drying wherein the coating and particles are mixed and atomized under heat; dry-on-dry coating wherein an impact mill is used to mix a ratio of 10× size core with 1× size coating particles; MAIC coating process wherein a magnetic field is used to assist the impaction coating process using vibrating screens that impact and screen particles during dry-on-dry coating thereby separating out coated from uncoated particles in a tower; vapor deposition coating wherein the particles to be coated are tumbled in a free radical pyrolysis zone; spinning-disc coating wherein the particles are released from the edges of a spinning film coater with polymer solution into a drying tower; spray chilling coating wherein a PEO/Wax melt coating is applied to particles at 100% solids; extrusion encapsulation wherein the coating is pumped through concentric tubes (outer) and particle (inner) through a concentric nozzle into a curing bath; spray congealing coating wherein the particles and coating are sprayed into in a hardening bath; interfacial condensation wherein the particles are activated with a coupling agent and are slurried in a reactive polymer or monomer; and coacervation coating wherein the polymer and particles are mixed in a slurry, after which the liquid is evaporated wherein the process is improved by coacervate precipitation with polymer of opposite charge or other insolubilization method. Additionally, as mentioned above, the micro-encapsulation method described fully in U.S. Pat. No. 5,962,134 to Shah et al. would be operative in the present invention. Of course other micro-encapsulation methods known in the art and not specifically discussed herein would also be operable and are considered within the scope of the present invention.

The grit may be encapsulated in any of a number of different resins as discussed above, but preferably is encapsulated in an aminoplast or phenoplast resin. Most preferably, the resin is melamine-formaldehyde resin. The micro-encapsulated grit may be cured using any of the known curing methods. Examples of curing methods that would be operable in accordance with the present invention include spray drying, spray drying with a flame treatment, ionizing radiation treatment, and oxidative congealing. Oxidative congealing is considered preferable for some applications because it is a virtually instantaneous aqueous quenching process resulting in a cured melamine resin coating on the grit along for a high throughput. Furthermore, oxidative congealing produces a cured grit coating that has rough protrusions which interlock with the paper fiber, potentially reducing fall off and migration during lamination. Spray drying with a flame treatment is also considered preferred for some applications. As mentioned previously, in the case of the "wet end" additions, it is preferable that the micro-encapsulated grit be fully cured. However, in the preferred embodiment that calls for a "dry end" addition, it is preferable that the micro-encapsulated grit only be partially cured for the reasons discussed herein.

For the slot orifice coater addition embodiment disclosed herein, the grit slurry employed in accordance with the present invention will typically include a binder material. The binder material may be any of the commonly used binders such as melamine resins, polyvinyl alcohol, acrylic latex, starch, casein, styrene-butadiene latex, carboxymethyl cellulose (CMC), microcrystalline cellulose, sodium alginate, etc., or mixtures thereof which are used in coating compositions where the coating material is to be bonded to a substrate such as a decor sheet or overlay sheet. Melamine resins such as melamine-formaldehyde are advantageously used as the binder material in the present invention since the melamine-formaldehyde resin is also commonly used to saturate the decor sheet. The binder is usually employed in an amount of about 1 to 10% by weight of coating solids. It is noted that when the micro-encapsulated grit coating is from a headbox, either primary or secondary, binders may or may not be used.

For the "wet end" addition of the micro-encapsulated grit through the primary or secondary headbox, solid composition (by weight) of the slurry is preferably between 0.5 and 5%, and more specifically, generally between 1 and 2% For the "wet end" addition using a slot orifice coater, the micro-encapsulated grit slurry medium can contain about 5 to 95% and, preferably, about 10 to 80% micro-encapsulated grit by weight. As such, the slurry preferably has a viscosity of about 50 to 150 cps when coating from a bead-type slot orifice coater and about 50 to 500 cps when coating form a curtain-type slot orifice coater. For curtain coating, the slurry preferably also includes a small amount of a surfactant (0.05 to 0.5%).

For all embodiments of the invention disclosed herein wherein the finished product is an overlay sheet, the overlay sheet is preferably formed from fibers conventionally used for such purpose and, preferably, is a bleached kraft pulp. The pulp may consist of hardwoods or softwoods or a mixture of hardwoods and softwoods which is normally preferred. Higher alpha cellulose such as cotton may be added to enhance certain characteristics such as post-formability. The basis weight of the uncoated overlay sheet may range from about 10 to 40 pounds per 3000 square feet, and preferably about 15 to 40 pounds per 3000 square feet.

It is generally desired that the finished laminate made using an overlay or decor sheet made by the methods of the present invention have abrasion values of between 1,500 to 20,000 cycles (NEMA: LD3.13). These desired abrasion values can be achieved by selecting the grit, the micro-encapsulation resin, the base stock, and the micro-encapsulated grit coating methods and conditions, and the saturation resin as is known in the art.

As best shown in FIG. 1, one preferred method for producing paper 10A for use in wear-resistant laminates in accordance with the present invention involves depositing the micro-encapsulated grit on and through the paper at the "wet end" of the paper machine by means of the primary headbox 12A. In this embodiment, the micro-encapsulated grit is first mixed with the paper fibers and water to form a paper slurry 14A. If the paper that is being made is a decor sheet, rather than just a standard non-decorative wear-resistant overlay, decorative materials such as paper chips or pigments can be added during this step. Once the slurry 14A is sufficiently homogenized, it is fed to the primary headbox 12A and then coated over the wire 16A to form a paper web 18A. The paper web 18A is then pulled through the dryers 20A, preferably including felt and can dryers, in order to remove the remaining moisture in the web 18A as known in the art. The web 18A then passes over an inspection and final drying area 22A prior to winding at the winder 24A. Once wound, the resultant product is ready for shipping to the consumer for incorporation in a decorative laminate as is known in the art.

Figure 2:
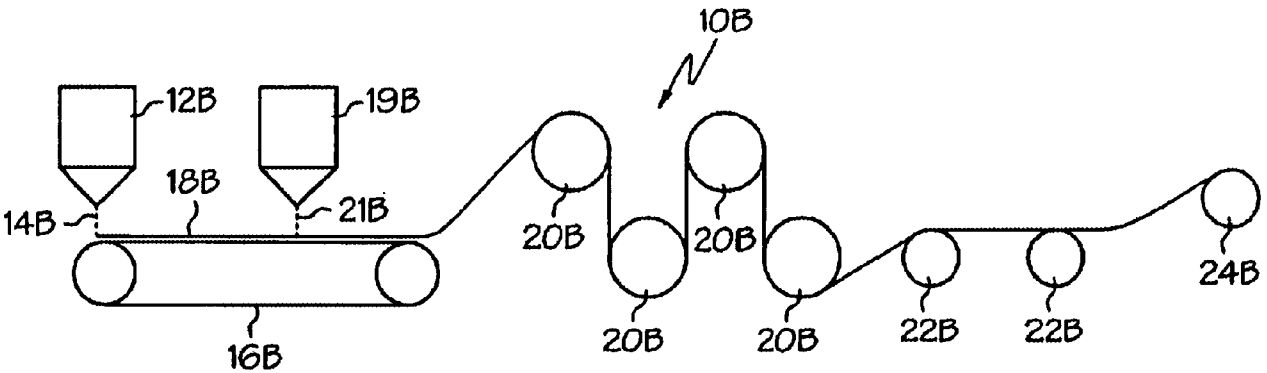
FIG. 2 is a schematic diagram of a papermaking process for use in accordance with an embodiment of the method of the present invention wherein the micro-encapsulated grit is deposited on the web through a secondary headbox.

As best shown in FIG. 2, in another embodiment of the present invention the micro-encapsulated grit is applied using a secondary headbox 19B at the "wet end" of the paper machine by means of the primary headbox 12A. In this embodiment, the micro-encapsulated grit is kept separate from the paper fibers until after the paper fibers have been coated on the wire 16B. First the paper fibers are mixed with water to form a paper slurry 14B. As with the prior embodiment, if the paper that is being made is a decor sheet, rather than just a standard non-decorative wear-resistant overlay, decorative materials such as paper chips or pigments can be added during this step. Once the slurry 14B is sufficiently homogenized, it is fed to the primary headbox 12B and then coated over the wire 16B to form a paper web 18B. At some point along the wire 16B, but prior to the dryers 20B, the secondary headbox 19B is positioned. A slurry of micro-encapsulated grit and water 21B, having been mixed and homogenized prior to addition to the secondary headbox 19B, is then added to the web 18B. The paper web 18B is then pulled through the dryers 20B, preferably including felt and can dryers, in order to remove the remaining moisture in the web 18B as known in the art. The web 18B then passes over an inspection and final drying area 22B prior to winding at the winder 24B. Once wound, the resultant product is ready for shipping to the consumer for incorporation in a decorative laminate as is known in the art.

Figure 3:
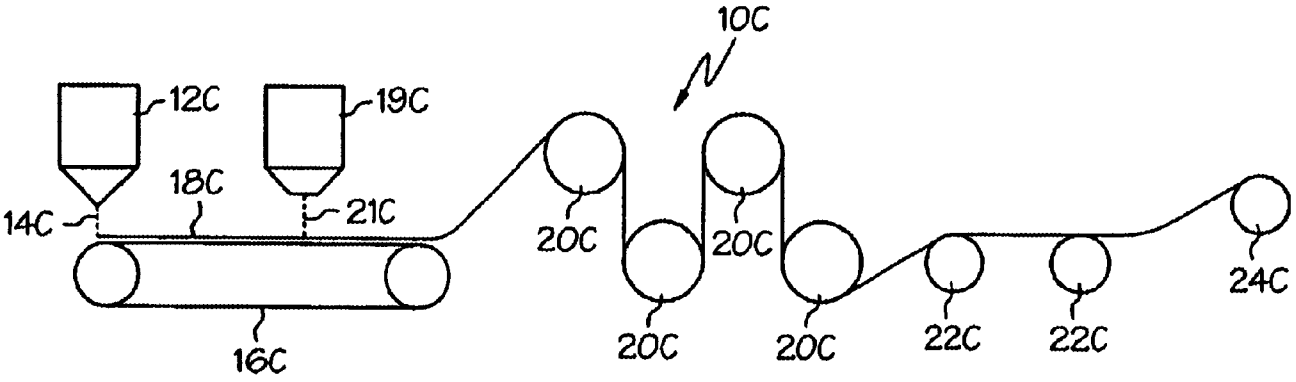
FIG. 3 is a schematic diagram of a papermaking process for use in accordance with an embodiment of the method of the present invention wherein the micro-encapsulated grit is deposited on the web through a slot orifice coater.

As best shown in FIG. 3, in another embodiment of the present invention, the micro-encapsulated grit is applied using a slot orifice coater 19C on the wet end of paper machine. The term "slot orifice coater" as used herein is used in the same manner it is used in the art, namely, to designate a coater having a central cavity which opens on and feeds a slot through which the coating is forced under pressure. Examples of slot orifice coaters useful in the present invention include curtain coaters in which the overlay is coated as it passes through a falling curtain of the coating composition and coaters in which the overlay is coated as it contacts a bead of the coating composition as it is extruded from a slot orifice. The latter type coaters can be oriented to coat the substrate as it passes directly above the coater, directly below the coater or to the side of the coater. The slot width of the slot orifice coaters used in the process typically range from 0.4 to 0.8 mm. The gap height (i.e., the distance between the edge of the slot orifice and the substrate surface) is about 0.5 to 1.55 mm when coating form a bead and about 2.5 to 25 mm when coating form a curtain. The coating head pressure is about 5 to 25 psig when coating form a bead and about 5 to 150 psig when coating from a curtain. A slot orifice coater useful in the present invention is sold by Liberty Tool Corp. under the tradename Technikote. Other manufacturers also make slot orifice coaters useful herein.

In this preferred embodiment, the use of a slot orifice coater 19C (as contrasted with the primary headbox 12A or secondary headbox 19B) increases the efficiency and uniformity of the micro-encapsulated grit application and reduces waste. In this embodiment, as with the use of a secondary headbox 19B, the micro-encapsulated grit is kept separate from the paper fibers until after the paper fibers have been coated on the wire 16C. First the paper fibers are mixed with water to form a paper slurry 14C. As with the prior embodiments, if the paper that is being made is a decor sheet, rather than just a standard non-decorative wear-resistant overlay, decorative materials such as paper chips or pigments can be added during this step. Once the slurry 14C is sufficiently homogenized, it is fed to the primary headbox 12C and then coated over the wire 16C to form a paper web 18C. At some point along the wire 16C, but prior to the dryers 20C, the slot coater 19C is positioned. A slurry of micro-encapsulated grit and water 21C, having been mixed and homogenized prior to addition to the slot coater 19C, is then added to the web 18C. The paper web 18C is then pulled through the dryers 20C, preferably including felt and can dryers, in order to remove the remaining moisture in the web 18C as known in the art. The web 18C then passes over an inspection and final drying area 22C prior to winding at the winder 24C. Once wound, the resultant product is ready for shipping to the consumer for incorporation in a decorative laminate as is known in the art.

Figure 4:
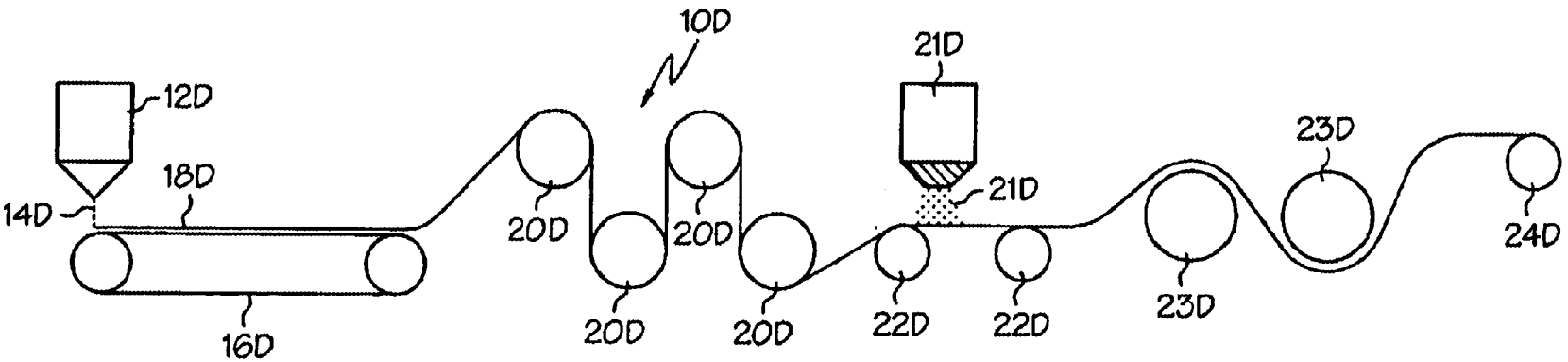
FIG. 4 is a schematic diagram of a papermaking process for use in accordance with an embodiment of he method of the present invention wherein the micro-encapsulated grit is deposited on the web at the "dry end" of the papermaking process.

As best shown in FIG. 4, in another embodiment of the present invention, the micro-encapsulated grit is applied at the "dry end" of the papermaking machinery thereby preventing unnecessary wear on the paper drying machinery and felts. In a preferred version of this embodiment, the micro-encapsulated grit is preferably only partially cured thereby enhancing the ability of the micro-encapsulated grit particles to adhere to the paper. In this preferred embodiment, as with the use of a secondary headbox 19B and slot orifice coater 19C, the micro-encapsulated grit is kept separate from the paper fibers until after the paper fibers have been coated on the wire 16D and dried by the dryers 20D. First the paper fibers are mixed with water to form a paper slurry 14D. As with the prior embodiments, if the paper that is being made is a decor sheet, rather than just a standard non-decorative wear-resistant overlay, decorative materials such as paper chips or pigments can be added during this step. Once the slurry 14D is sufficiently homogenized, it is fed to the primary headbox 12D and then coated over the wire 16D to form a paper web 18D. The paper web 18D is then pulled through the dryers 20D, preferably including felt and can dryers, in order to remove the remaining moisture in the web 18D as known in the art. At some point after the dryers 20D, the micro-encapsulated grit 21D, in powder form, is spread across the web 18D using a powder applicator or like machinery. Preferably, the micro-encapsulated grit 21D is only partially cured to aid the particles in adhering to the web 18D. In a preferred embodiment, the web 18D is then passed through chilled rollers 23D to finish the curing of the micro-encapsulated grit as well as to help set the micro-encapsulated grit 21D on the web 18D. The web 18D is then fed to the winder 24D. Once wound, the resultant product is ready for shipping to the consumer for incorporation in a decorative laminate as is known in the art.

Having described the invention in detail, it will be apparent that modifications and variations are possible without departing from the scope of the invention defined in the appended claims:

What is claimed is:

1. A method for forming an abrasion resistant paper sheet for use in decorative laminates comprising the steps of:

mixing cellulosic feedstock and water to form a cellulosic slurry;

depositing said cellulosic slurry from a primary headbox onto a wire of a papermaking machine to form a web;

mixing melamine formaldehyde-encapsulated grit particles with water to form a melamine formaldehyde-encapsulated grit slurry;

depositing said melamine formaldehyde-encapsulated grit slurry on said web using a secondary headbox or a slot orifice coater after said primary headbox but prior to papermaking drying equipment;

drying said web using said drying equipment; and winding said web to form a roll of abrasion resistant paper.

2. The method of claim 1 wherein said melamine formaldehyde-encapsulated grit particles include melamine formaldehyde-encapsulated aluminum oxide particles.

3. The method of claim 1 wherein said melamine formaldehyde-encapsulated grit particles are partially cured.

4. The method of claim 1 wherein said melamine formaldehyde-encapsulated grit particles include mineral particles ranging in average particle size from about 10 to 100 microns.

5. The method of claim 1 wherein said melamine formaldehyde-encapsulated grit particles have a rough-textured or rosette surface.

6. The method of claim 5 wherein said melamine formaldehyde-encapsulated particles are cured using oxidative congealing.

7. The method of claim 1 wherein said melamine formaldehyde-encapsulated grit slurry includes carboxymethyl cellulose.

8. The method of claim 1 wherein said melamine formaldehyde-encapsulated grit slurry includes microcrystalline cellulose.

9. The method of claim 1 wherein said melamine formaldehyde-encapsulated grit particles include melamine formaldehyde-encapsulated silica.

10. The method of claim 1 wherein said melamine formaldehyde-encapsulated grit particles include melamine formaldehyde-encapsulated silica.

11. A method for forming an abrasion resistant paper sheet for use in decorative laminates comprising the steps of:

mixing cellulosic feedstock, melamine formaldehyde-encapsulated grit particles and water to form a slurry;

depositing said slurry from a primary headbox onto a wire of a papermaking machine to form a web;

drying said web using said drying equipment; and winding said web to form a roll of abrasion resistant paper.

12. The method of claim 11 wherein said melamine formaldehyde-encapsulated grit particles include melamine formaldehyde-encapsulated aluminum oxide particles.

13. The method of claim 11 wherein said melamine formaldehyde-encapsulated grit particles are partially cured.

14. The method of claim 11 wherein said melamine formaldehyde-encapsulated grit particles include mineral particles ranging in average particle size from about 10 to 100 microns.

15. The method of claim 11 wherein said melamine formaldehyde-encapsulated grit particles have a rough-textured or rosette surface.

16. The method of claim 15 wherein said melamine formaldehyde-encapsulated grit particles are cured using oxidative congealing.

17. The method of claim 11 wherein said melamine formaldehyde-encapsulated grit slurry includes carboxymethyl cellulose.

18. The method of claim 11 wherein said melamine formaldehyde-encapsulated grit slurry includes microcrystalline cellulose.

19. The method of claim 11 wherein said melamine formaldehyde-encapsulated grit particles include melamine formaldehyde-encapsulated silica.

20. A method for forming an abrasion resistant paper sheet for use in decorative laminates comprising the steps of:

mixing cellulosic feedstock and water to form a cellulosic slurry;

depositing said cellulosic slurry from a primary headbox onto a wire of a papermaking machine to form a web;

drying said web using drying equipment;

depositing melamine formaldehyde-encapuslated grit particles on said web using a powder coater; and winding said web to form a roll of abrasion resistant paper.

21. The method of claim 20 wherein said melamine formaldehyde-encapsulated grit slurry includes carboxymethyl cellulose.

22. The method of claim 20 wherein said melamine formaldehyde-encapsulated grit particles include melamine formaldehyde-encapsulated aluminum oxide particles.

23. The method of claim 20 wherein said melamine formaldehyde-encapsulated grit particles are partially cured.

24. The method of claim 20 wherein said melamine formaldehyde-encapsulated grit particles include mineral particles ranging in average particle size from about 10 to 100 microns.

25. The method of claim 20 wherein said melamine formaldehyde-encapsulated grit particles have a rough-textured or rosette surface.

26. The method of claim 25 wherein said melamine formaldehyde-encapsulated particles are cured using oxidative congealing.

27. The method of claim 20 wherein said melamine formaldehyde-encapsulated grit slurry includes microcrystalline cellulose.

* * * * *